US011933199B2

(12) United States Patent
Biermann et al.

(10) Patent No.: US 11,933,199 B2
(45) Date of Patent: Mar. 19, 2024

(54) SWITCHABLE FINGER FOLLOWER FOR A VALVE TRAIN OF AN INTERNAL COMBUSTION ENGINE

(71) Applicant: Schaeffler Technologies AG & Co. KG, Herzogenaurach (DE)

(72) Inventors: Andreas Biermann, Fürth (DE); Rainer Schwinn, Obermichelbach (DE); Adrian Bilan, Fürth (DE); Brian Koop, Fürth (DE); Jinhwan Jeon, Nuremberg (DE); Frank Himsel, Obermichelbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 18/024,172

(22) PCT Filed: Aug. 10, 2021

(86) PCT No.: PCT/DE2021/100679
§ 371 (c)(1),
(2) Date: Mar. 1, 2023

(87) PCT Pub. No.: WO2022/048703
PCT Pub. Date: Mar. 10, 2022

(65) Prior Publication Data

US 2023/0279788 A1 Sep. 7, 2023

(30) Foreign Application Priority Data

Sep. 2, 2020 (DE) ..... 10 2020 122 920.8

(51) Int. Cl.
*F01L 1/18* (2006.01)
*F01L 1/46* (2006.01)

(52) U.S. Cl.
CPC ..... *F01L 1/185* (2013.01); *F01L 2001/186* (2013.01); *F01L 2001/467* (2013.01); *F01L 2305/02* (2020.05)

(58) Field of Classification Search
CPC ..... F01L 1/185; F01L 2001/186; F01L 2001/467
(Continued)

(56) References Cited

U.S. PATENT DOCUMENTS 2,905,160 A 9/1959 Sampietro
2017/0234172 A1* 8/2017 Schmidt ..... F01L 1/18 123/90.5

(Continued)

FOREIGN PATENT DOCUMENTS

CN 205117435 U * 3/2016
DE 3209086 C1 4/1983

(Continued)

*Primary Examiner* — Jorge L Leon, Jr.

(57) ABSTRACT

A switchable finger follower for a valve train of an internal combustion engine includes an outer and an inner lever, which at a first longitudinal end run pivotably relative to one another via respective bores on a common shaft. At this longitudinal end, the finger follower has a gas-exchange valve contact face on an underside. The outer lever has a pivot bearing on the underside at a further longitudinal end, and at least the inner lever has a cam running face on an upper side. The inner and outer levers are connectable to one another via at least one coupling slide, which spans a separation area between the levers. The outer and inner levers are braced relative to one another via a cam return spring, and the shaft is connected to the bore of the outer lever by an interference fit. To mount the inner lever relative to the shaft without radial play but in a rotatable fashion, the bore of the inner lever includes, in its semi-circular segment facing the upper side, a pointed arch composed of two circular arcs as contact means.

18 Claims, 2 Drawing Sheets

(58) Field of Classification Search
USPC ..... 123/90.41, 90.44
See application file for complete search history.

(56) References Cited

U.S. PATENT DOCUMENTS

| | | | | |
|---|---|---|---|---|
| 2018/0045081 | A1* | 2/2018 | Rehm | F01L 13/0005 |
| 2019/0257220 | A1* | 8/2019 | Borraccia | F01L 1/185 |

FOREIGN PATENT DOCUMENTS

| | | | |
|---|---|---|---|
| DE | 102008017316 | A1 | 10/2009 |
| DE | 102016204456 | A1 | 2/2017 |
| DE | 102018110573 | A1 | 11/2019 |
| EP | 1462619 | A1 | 9/2004 |
| WO | 2005093225 | A1 | 10/2005 |
| WO | 2016023543 | A1 | 2/2016 |
| WO | 2019228670 | A1 | 12/2019 |

* cited by examiner

SWITCHABLE FINGER FOLLOWER FOR A VALVE TRAIN OF AN INTERNAL COMBUSTION ENGINE

CROSS-REFERENCE TO RELATED APPLICATIONS

This application is the U.S. National Phase of PCT Application No. PCT/DE2021/100679 filed on Aug. 10, 2021, which claims priority to DE 10 2020 122 920.8 filed on Sep. 2, 2020, the entire disclosures of which are incorporated by reference herein.

TECHNICAL FIELD

The disclosure relates to a switchable finger follower for a valve train of an internal combustion engine.

BACKGROUND

DE 10 2016 204 456 A1, FIG. 1, shows a generic finger follower of the switchable type. The outer and inner levers run together on its shaft at one longitudinal end. The shaft sits either in the bore of the outer lever or in the bore of the inner lever via an interference fit by means of a press fit. The other lever (inner lever/outer lever), on the other hand, runs with radial play (clearance fit) over its bore on the shaft. A piston is provided as the coupling slide, which runs at the other end of the finger follower in the outer lever above the pivot bearing and can be displaced in sections under a driver surface on the free pivoting end of the pawl-like inner lever for coupling.

A further switchable finger follower of the same design is disclosed in DE 10 2018 110 573 A1, FIG. 1. At one end on the valve side, the inner and outer levers run on a common shaft. The shaft is in turn pressed either to the outer lever or to the inner lever. The respective other lever (inner lever or outer lever) runs with radial play (clearance fit) in relation to its bore.

SUMMARY

The object is to design a switchable finger follower in which the possibility of displacement due to radial play of the inner or outer lever that is not firmly connected to the shaft is avoided with simple means.

According to the disclosure, this object is achieved by the features of an example embodiment described herein, according to which the bore or aperture of the inner lever in its semi-circular segment facing the upper side consists of a pointed arch composed of two circular arcs as the contact means in order to mount the inner lever relative to the shaft without radial play but in a rotatable fashion.

Alternatively, this object is achieved by the features of a further example embodiment, according to which the bore of the outer lever in its semi-circular segment facing the underside consists of a pointed arch composed of two circular arcs as the contact means in order to mount the outer lever relative to the shaft without radial play but in a rotatable fashion.

With these simple measures of safe "bracing" of the inner or outer lever via well-defined line contact on the two arches of the respective pointed arch, which can also be described as a Gothic profile, the radial play from the respective slewing ring is safely eliminated, with the possibility of relative rotation of the inner or outer lever relative to the shaft. Thus, only one of the bore partners has a fully circular profile.

The above applies to the merely braced state via the cam return spring of the outer and inner lever. This is particularly true and significant, however, for a full cam running contact. All in all, a switchable finger follower that safely couples and decouples is provided.

By eliminating the radial play in the respective bore section, a safe and aligned position of the inner lever with its driver surface in relation to the coupling slide of the outer lever is always provided. Undesirable switching errors, such as those that can occur, for example, when the coupling piston is only slightly and insufficiently moved into the counter-contour (edge contact) in the case of cam approach flank contact, no longer lead to a breakage/"smearing" of the contact with the risk of destroying the coupling piston and/or sudden pivoting of the inner lever in relation to the outer lever due to the possibility of displacement due to radial play of the inner or outer lever. In this worst-case scenario, the inner lever can be aligned with the outer lever, but it can also be at a slight angle to it, so that the coupling slider does not initially enter its counter-contour with its entire width.

According to the disclosure, "finger followers" include any type of switchable cam follower finger, including shaft-mounted cam followers, cam follower groups or rocker arms or rocker arm groups. If necessary, the pointed arch profile can also be composed of more than two arches (a multiple of two). It is also possible to leave the shaft completely "flying", i.e., without any pressing or the like, in relation to both bore partners.

As an alternative and of equal importance to the measures on the respective bore, only the shaft in the respective enclosing section can be provided with the Gothic profile. In this case, however, it must be installed in the correct direction.

An elimination of radial play that can be controlled particularly well is present when the contact points of the pointed arch enclose an angle of approximately 45°, as formulated in an expedient development of the disclosure.

Finally, a further example embodiment relates to an advantageous design of the coupling area. The primary coupling element is, for example, a piston that can be displaced longitudinally in or under a driver surface of the inner lever. This can, for example, be actuated directly via hydraulic or electromagnetic means. However, it is also conceivable and provided for the coupling slides to be in the form of a pack of slides which can also be actuated transversely on the outside.

DETAILED DESCRIPTION

Figure 1:
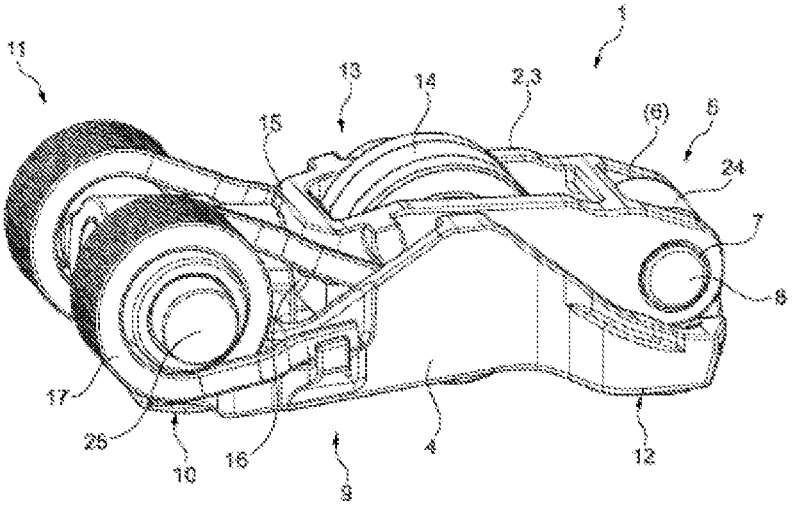
FIG. 1 shows a three-dimensional view of a switchable finger follower at an angle from above.

FIG. 1 discloses a switchable finger follower 1 in terms of its basic structure. The finger follower 1 consists of a box-like outer lever 4, which flanks the arms 2 of an inner lever 3 in sections. At a first longitudinal end 5 of the finger follower 1, the outer and inner levers 4, 3 run pivotably relative to one another via respective apertures or bores 6, 7 on a common shaft 8. As can be seen, the inner lever 3 is designed in the shape of a fork and rests on the outer sides of an attachment 24 of the outer lever 4.

At the longitudinal end 5 just mentioned (shown here on the right), the outer lever 4 has a gas-exchange valve contact face 12 on an underside 9. At a further longitudinal end 11 (see left-hand side of the figure), the outer lever 4 has a pivot bearing 10 on the underside 9, which is provided as a spherical cap for mounting on a support element fixed to the cylinder head (see also FIG. 2). A retaining clip 27 that is usually used is also drawn in this area. The inner lever 3 also has a cam running face 14 designed as a roller on an upper side 13 of the finger follower 1, which is framed by its arms 2. The outer lever 4 is not contacted by lifting cams.

Above the pivot bearing 10, a longitudinally extendable coupling slide 16 is installed. Upstream of this is a piston group 26 (not explained in more detail) with link deflection (see also FIG. 2), the outer piston 25 of which runs transversely to the longitudinal extension of the lever and can be acted upon on the outer end face via, for example, an electromagnetic servo means in the retraction direction.

For coupling (as shown) of the inner lever 3 with the outer lever 4 (cam base circuit passage), the piston-like coupling slide 16 is displaced in sections over a separation area 15 between the outer and inner lever 4, 3 under a driver surface 21 designed as a transverse bar at the free end face 22 of the inner lever 3.

Finally, it should also be noted that the outer and inner levers 4, 3 are braced against one another via cam return spring means 17. These are provided in the form of two torsion springs applied to the further longitudinal end 11 and are also referred to as "lost motion springs".

The shaft 8 is pressed within the bore 6 of the outer lever 4. The highlight here is that contact means 18 are applied between the shaft 8 and the bore 7 of the inner lever 3, via which the inner lever 3 is free of radial play but can rotate relative to the shaft 8. For this purpose, the bore 7 of the inner lever 3 has the profile of a pointed arch 19 (Gothic profile) in its semi-circular segment facing the upper side 13. The shaft 8 encompassed by this is cylindrical.

Figure 2:
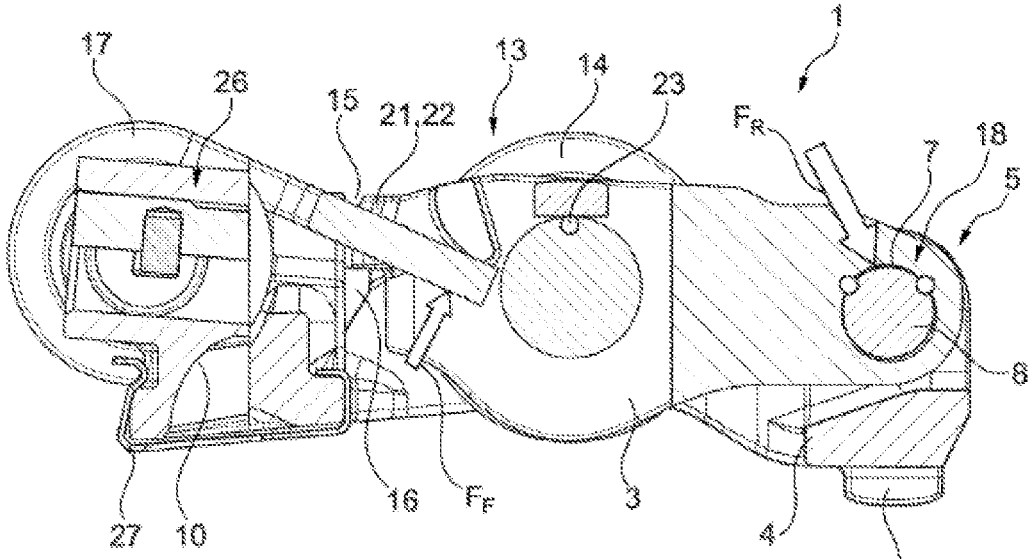
FIG. 2 shows a side view, partially cut in the coupling area, of the finger follower along an outer wall of its inner lever.
Figure 3:
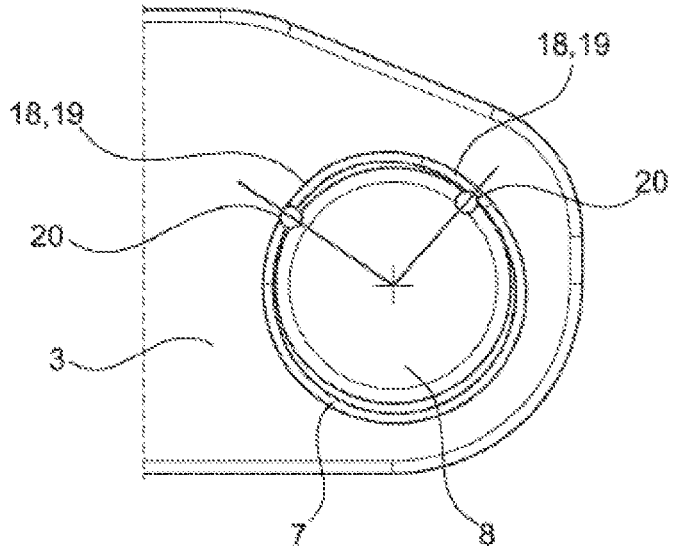
FIG. 3 shows the bore area of the inner lever in detail.

In FIGS. 2 and 3, the permanent contact areas or points 20 of the shaft 8 are located on the two separately prepared circular arcs of the pointed arch 19. Because of this line contact, any radial play is eliminated from this bore area. In the undesired case of a coupling slide 16 "beaked" only partially into the driving surface 21 at the end face of the inner lever 3 at the beginning of the cam approach flank, with or without an inclined position of the inner lever 3, this contact no longer breaks off due to a radial mobility of the inner lever 3 relative to the shaft 8 at one longitudinal end 5. To put it simply, the inner lever 3 can no longer leave this initial contact by making an evasive movement.

As shown in FIG. 3, the "resulting" contact points 20 on the two circular arcs of the upper semi-circular segment enclose an angle of approximately 45° with the pointed arch 19. The comprehensive area of the bore 7 of the inner lever 3 is shown as thickened for reasons of improved clarity.

LIST OF REFERENCE SYMBOLS

1) Finger follower
2) Arm
3) Inner lever
4) Outer lever
5) Longitudinal end
6) Outer lever bore
7) Inner lever bore
8) Shaft
9) Underside
10) Pivot bearing
11) Longitudinal end
12) Gas-exchange valve contact face
13) Upper side
14) Cam running face
15) Separation area
16) Coupling slide
17) Cam return spring means
18) Contact means
19) Pointed arch
20) Contact point
21) Driver surface
22) End face
23) Contact point height stop
24) Attachment
25) Outer piston
26) Piston group
27) Retaining clip

The invention claimed is:

1. A switchable finger follower for a valve train of an internal combustion engine, the switchable finger follower comprising:

an outer lever including a first bore;

an inner lever including a second bore, the inner lever configured to pivot relative to the outer lever via a cylindrical shaft disposed within the first and second bores, a gas-exchange valve contact face arranged on an underside of a first longitudinal end of the switchable finger follower, a pivot bearing arranged on the underside at a second longitudinal end of the switchable finger follower, the pivot bearing configured for mounting the switchable finger follower within the internal combustion engine, a cam running face arranged on an upper side of the switchable finger follower, at least one coupling slide configured to selectively couple the inner lever to the outer lever so as to be rotationally locked to each other, and a cam return spring configured to brace the inner lever relative to the outer lever, wherein the second bore includes a Gothic profile comprised of two circular arcs configured to contact the cylindrical shaft such that the inner lever is further configured to pivot relative to the cylindrical shaft without radial play.

2. The switchable finger follower according to claim 1, wherein the two circular arcs contact the cylindrical shaft at a first contact point and a second contact point, respectively, and wherein the first contact point and the second point are angularly offset from each other.

3. The switchable finger follower according to claim 1, wherein the cylindrical shaft is fixed to the first bore via an interference fit.

4. The switchable finger follower according to claim 1, wherein the at least one coupling slide is arranged above the pivot bearing.

5. The switchable finger follower of claim 1, wherein the cylindrical shaft is arranged at the first longitudinal end of the switchable finger follower.

6. The switchable finger follower of claim 5, wherein the cam running face is arranged at least on the inner lever.

7. The switchable finger follower of claim 6, wherein the cam running face is configured as a roller.

8. A switchable finger follower for a valve train of an internal combustion engine, the switchable finger follower comprising:

an outer lever including a first bore, and an inner lever including a second bore, the inner lever configure to pivot relative to the outer lever via a cylindrical shaft disposed within the first and second bores, a gas-exchanged valve contact face arranged on an underside of a first longitudinal end of the switchable finger follower, a pivot bearing arranged on the underside at a second longitudinal end of the switchable finger follower, the pivot bearing configured for mounting the switchable finger follower within the internal combustion engine, a cam running face arranged on an upper side of the switchable finger follower, at least one coupling slide configured to selectively couple the inner lever to the outer lever so as to be rotationally locked to each other, and a cam return spring configured to brace the inner lever relative to the outer lever, wherein the first bore includes a Gothic profile comprised of two circular arcs configured to contact the cylindrical shaft such that the outer lever is configured to pivot relative to the cylindrical shaft without radial play.

9. A switchable finger follower for a valve train of an internal combustion engine, the switchable finger follower comprising:

an outer lever including at least one first aperture, an inner lever including at least one second aperture, the inner lever configured to pivot relative to the outer lever via a cylindrical shaft disposed within the at least one first aperture and the at least one second aperture, a gas exchange valve contact face at a first longitudinal end of the switchable finger follower, a pivot bearing arranged at a second longitudinal end of the switchable finger follower, a cam running face arranged on an upper side of the switchable finger follower, and at least one coupling slide configured to selectively couple the inner lever to the outer lever so as to be rotationally locked to each other, wherein at least one of the at least one first aperture or the at least one second aperture defines a Gothic profile comprised of two circular arcs configured to contact the cylindrical shaft such that the outer lever and/or the inner lever is configured to pivot relative to the cylindrical shaft without radial play.

10. The switchable finger follower of claim 9, wherein the two circular arcs respectively contact the cylindrical shaft via two separate contact areas.

11. The switchable finger follower of claim 9, wherein the at least one second aperture defines the Gothic profile, and the cylindrical shaft is fixed to the at least one first aperture via an interference fit.

12. The switchable finger follower of claim 11, wherein the at least one second aperture comprises two apertures.

13. The switchable finger follower of claim 9, further comprising a cam return spring arranged between the inner lever and the outer lever.

14. The switchable finger follower of claim 13, wherein the cam return spring is arranged at the second longitudinal end of the switchable finger follower.

15. The switchable finger follower of claim 13, wherein the cam return spring comprises two cam return springs and the at least one coupling slide is arranged between the two cam return springs.

16. The switchable finger follower of claim 9, wherein the cylindrical shaft is arranged at the first longitudinal end of the switchable finger follower.

17. The switchable finger follower of claim 9, wherein the cam running face is arranged at least on the inner lever.

18. The switchable finger follower of claim 9, wherein the inner lever further includes longitudinal arms, and the outer lever flanks the longitudinal arms.

* * * * *